US006509674B1

(12) United States Patent
Nakagawa

(10) Patent No.: US 6,509,674 B1
(45) Date of Patent: Jan. 21, 2003

(54) DISCHARGE LAMP WITH VENTILATION PASSAGE

(75) Inventor: Atsuji Nakagawa, Himeji (JP)

(73) Assignee: Phoenix Electric Co., Ltd., Himeji (JP)

( * ) Notice: Subject to any disclaimer, the term of this patent is extended or adjusted under 35 U.S.C. 154(b) by 0 days.

(21) Appl. No.: 09/427,552

(22) Filed: Oct. 27, 1999

(30) Foreign Application Priority Data

Oct. 30, 1998 (JP) ..... 10-310793
Jul. 16, 1999 (JP) ..... 11-203267

(51) Int. Cl.[7] ..... H01J 61/52

(52) U.S. Cl. ..... 313/113; 313/20; 313/24; 313/25; 313/45; 362/217; 362/225

(58) Field of Search ..... 313/113, 110, 313/20, 45, 24, 25, 579, 114, 26, 36; 362/217, 225, 218, 235, 260

(56) References Cited

U.S. PATENT DOCUMENTS 3,684,908 A * 8/1972 Beese ..... 313/24
4,053,759 A * 10/1977 Wilkinson ..... 362/218
4,423,348 A * 12/1983 Greiler ..... 313/113
4,925,295 A * 5/1990 Ogawa et al. ..... 353/57
5,377,086 A * 12/1994 Tickner ..... 362/225
5,506,464 A * 4/1996 Ooms ..... 313/113
5,947,590 A * 9/1999 Meuse et al. ..... 362/264
6,078,136 A * 6/2000 Sica ..... 313/493
6,133,676 A * 10/2000 Chen ..... 313/25
6,306,010 B1 * 10/2001 West et al. ..... 451/36

FOREIGN PATENT DOCUMENTS

JP 410223023 * 8/1998 ..... F21V/15/02
JP 11039934 A * 2/1999 ..... F21V/29/00
JP 11195322 A * 7/1999 ..... F21V/29/00
JP 411195322 * 7/1999 ..... F21V/29/00

* cited by examiner

*Primary Examiner*—Ashok Patel
*Assistant Examiner*—Sikha Roy
(74) *Attorney, Agent, or Firm*—Oblon, Spivak, McClelland, Maier & Neustadt, P.C.

(57) ABSTRACT

A discharge lamp is provided which employs a higher-pressure and higher-wattage lamp body 1 and is capable of effectively preventing the scattering of broken pieces of the lamp body 1 at explosion of the lamp body 1. The discharge lamp comprises a lamp body 1, a reflector 2 having the lamp body 1, and a front glass fitted on a front portion of the reflector 2, wherein the reflector 2 has vent holes 4 in which mesh sheets 6 or perforated plates 5 are fitted.

8 Claims, 21 Drawing Sheets

Conventional Art

DISCHARGE LAMP WITH VENTILATION PASSAGE

BACKGROUND OF THE INVENTION

1. Field of the Invention

The present invention relates to a discharge lamp to be used as a light source for a projector or the like and, more particularly, to a discharge lamp suitable for a high wattage light source.

2. Description of the Prior Art

Discharge lamps are widely used as light sources for various lighting apparatuses and, in recent years, also used as light sources for image projectors.

To increase the brightness of the projectors, an attempt has rapidly been made to produce a higher-pressure and higher-wattage discharge lamp. However, an increase in the inside pressure of the discharge lamp entails a high risk of explosion of the discharge lamp, because a gas filled in the discharge lamp expands due to a temperature rise of the discharge lamp when the discharge lamp is lit.

FIG. 21 is a vertical sectional view of a conventional discharge lamp, in which reference numerals 1 and 2 denote a lamp body and a reflector (reflection mirror), respectively.

A thick front glass 3 is fitted on a front portion of the reflector 2 so that, even if the lamp body 1 explodes, broken pieces thereof are prevented from scattering forwardly of the discharge lamp. That is, the lamp body 1 is hermetically enclosed by the reflector 2 and the front glass 3.

With the hermetically enclosed structure, however, air around the lamp body 1 is heated when the lamp body 1 is lit, so that the temperature in a hermetic space defined by the reflector 2 and the front glass 3 is significantly increased. In consideration of such thermal conditions, the upper limit of the wattage of the lamp body 1 is 150 W in practice and, therefore, it has been difficult to further increase the inside pressure and wattage of the lamp body.

It is therefore an object of the present invention to provide a discharge lamp which employs a higher-pressure and higher-wattage lamp body and is capable of effectively preventing the scattering of broken pieces of the lamp body at explosion of the lamp body.

SUMMARY OF THE INVENTION

In accordance with a first aspect of the present invention, there is provided a discharge lamp which comprises a lamp body, a reflector, and a front glass fitted on a front portion of the reflector, wherein the reflector has two vent holes in which mesh sheets or perforated plates are fitted. (FIGS. 1–4)

With this arrangement, air heated in an inside space of the reflector can be released from the discharge lamp through mesh of the mesh sheets or perforations of the perforated plates, so that an excessive temperature rise around the lamp body can be prevented. Therefore, a higher-pressure and higher-wattage lamp body having a wattage higher than 150 W can be employed as the lamp body to be housed in the inside space of the reflector of the discharge lamp.

In accordance with a second aspect of the present invention, there is provided a discharge lamp which comprises a lamp body, a reflector, and a front glass fitted on a front portion of the reflector, wherein the reflector has two vent holes in which plates formed with slits are fitted, wherein the plates have baffles provided along the slits for directing outside air introduced into an inside space of the reflector through the slits toward a high temperature portion of the lamp body. (FIGS. 5,6)

With this arrangement, outside air introduced into the inside space through the slits are allowed to uniformly flow toward the lamp body by the baffles to efficiently cool the ambience of the lamp body, and then released to the outside through another slits.

Thus, the ambient temperature of the lamp body is prevented from being excessively increased. Therefore, a higher-pressure and higher-wattage lamp body having a wattage higher than 150W can be employed as the lamp body of the discharge lamp.

In the discharge lamp according to the first or second aspect of the invention, the vent holes may be a through-hole formed in the reflector (FIGS. 7,8) or a cut-away portion formed in the reflector in association with the front portion thereof. (FIGS. 1–6)

With this arrangement, the reflector is effectively provided with the vent holes in which the mesh sheets or the perforated plates are fitted.

In accordance with a third aspect of the present invention, there is provided a discharge lamp which comprises a lamp body, a reflector, and a front glass fitted on a front portion of the reflector, wherein the reflector has two vent portions 51 having a multiplicity of through-holes 5*a* formed therein (FIGS. 9,10), or shaped like the teeth of a comb (FIGS. 11,12).

With this arrangement, the reflector itself functions as a perforated plate for ventilation without the use of the mesh sheet or the perforated plate.

In accordance with a fourth aspect of the present invention, there is provided a discharge lamp which comprises a lamp body, a reflector having the lamp body at the center of it, a ring spacer fitted on a front portion of the reflector, and a front glass fitted on a front portion of the ring spacer, wherein the ring spacer has vent holes having mesh of the mesh sheets, perforated plates or plates formed with a slit, wherein the plates have baffles provided along the slits for directing outside air introduced into an inside space of the reflector through the slits toward a high temperature portion of the lamp body.

In accordance with the fifth aspect of the present invention (FIGS. 19,20), the ring spacer has vent portions 51 having a multiplicity of through-holes formed therein ,or shaped like the teeth of a comb.

DETAILED DESCRIPTION OF THE PREFERRED EMBODIMENTS

The present invention will hereinafter be described by way of embodiments thereof.

First Embodiment

Figure 1:
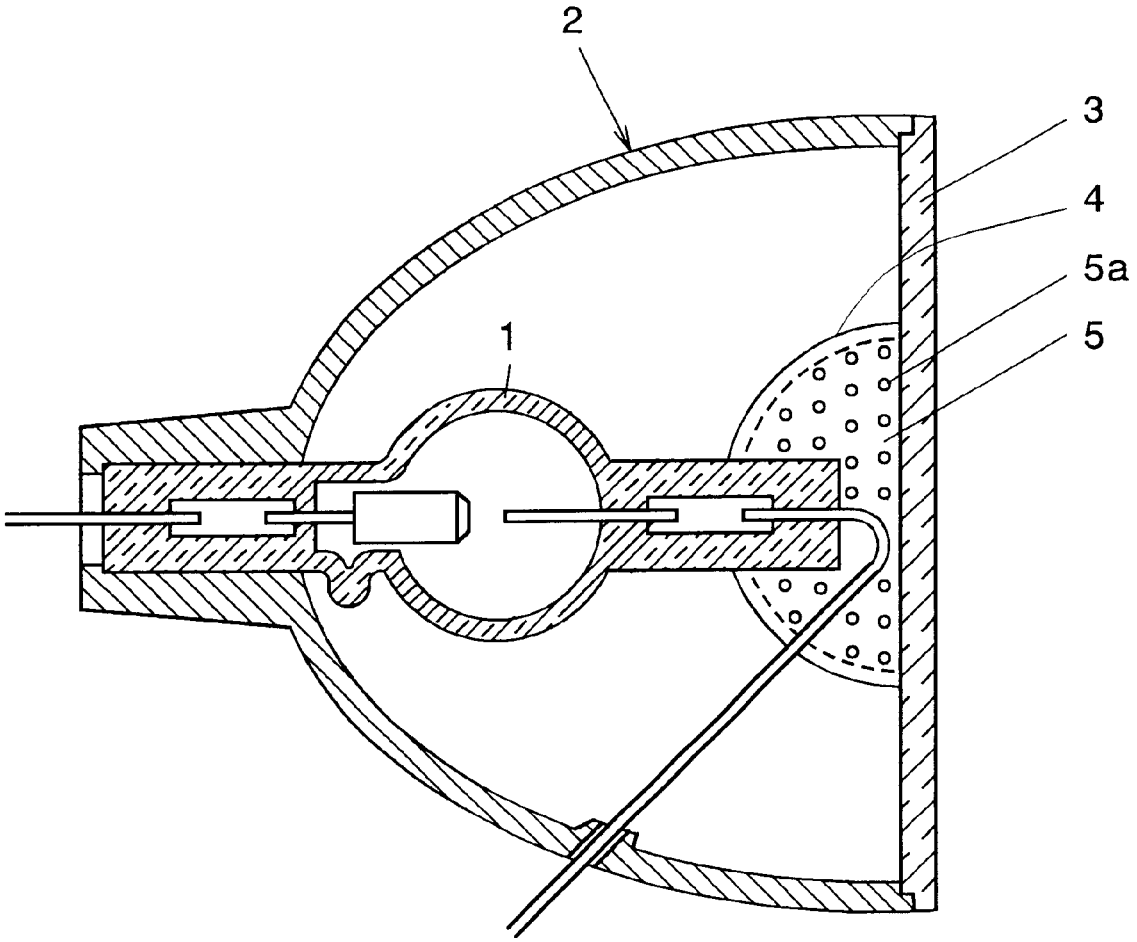
FIG. 1 is a vertical sectional view illustrating a first embodiment.
Figure 2:
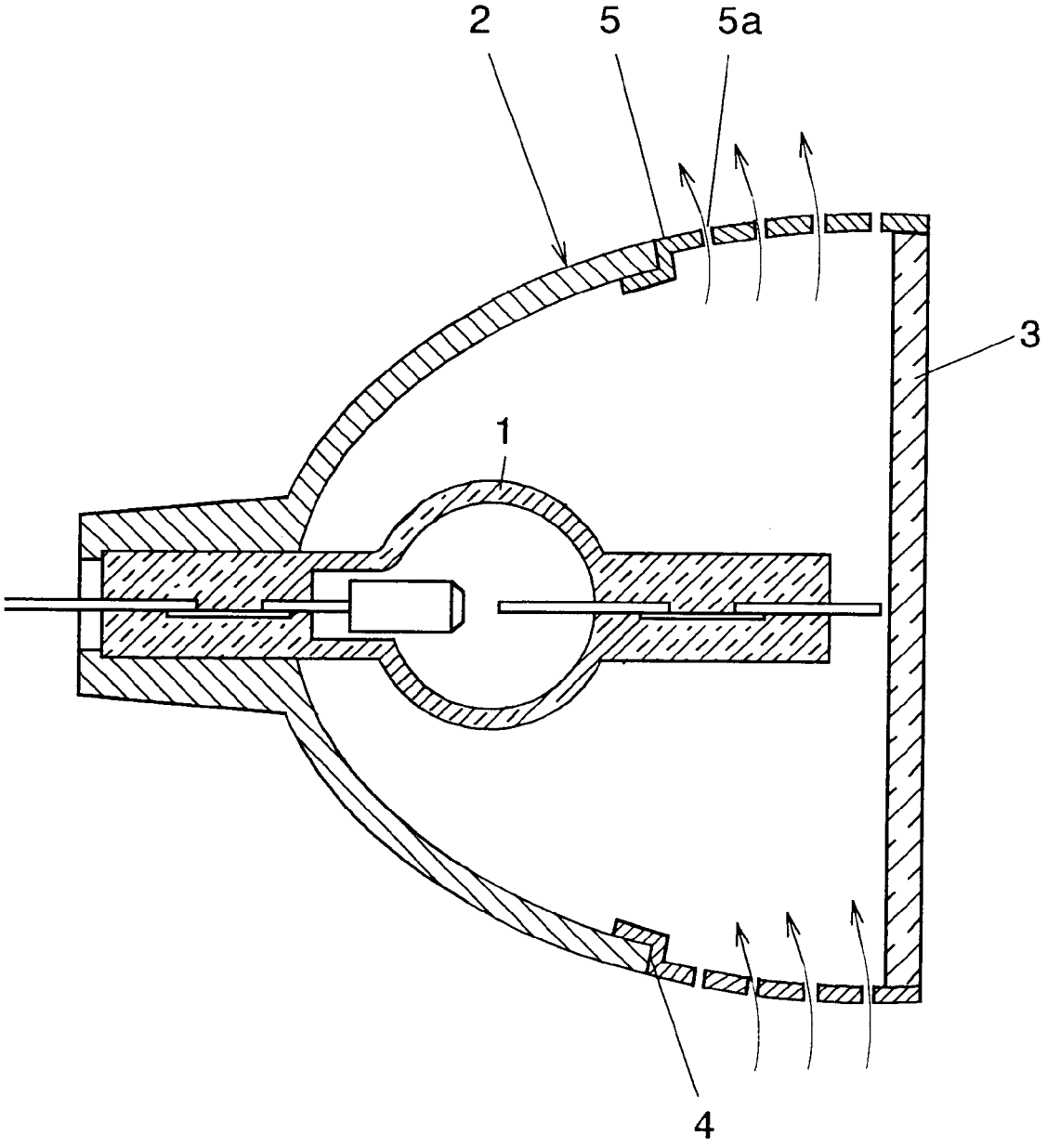
FIG. 2 is a cross sectional view illustrating the first embodiment.

FIGS. 1 and 2 are a vertical sectional view and a cross sectional view, respectively, illustrating a discharge lamp according to a first embodiment of the invention. As shown, the discharge lamp comprises a lamp body 1, a reflector 2 having the lamp body 1 at the center of it, and a front glass 3 fitted on a front portion of the reflector 2. The reflector 2 has two cut-away openings 4 as vent holes formed therein adjacent a front portion (on which the front glass 3 is fitted) thereof.

In this embodiment, portions of the reflector 2 adjacent to the front portion thereof have been cut away for the formation of the openings 4 for fitting mesh sheets or perforated plates (in communication with a front portion thereof). With this arrangement, machining for the formation of the openings 4 is easy, and the openings 4 formed in these portions are less liable to reduce the reflecting effect of the reflector.

In the present invention, the positions and configurations of the openings 4 are not limited to those illustrated, but the openings 4 may have any shape such as a circular, oval or rectangular shape and be formed in non-contact with the front portion.

Punched metal plates, ceramic plates with perforations or heat-resistant plastics plates with perforations as perforated plates 5 are respectively fitted in the openings 4 of the reflector 2.

Although the punched metal plates, punched ceramic plates with perforations or heat-resistant plastics plates with perforations are used as the perforated plates 5 in this embodiment, plates each formed with a multiplicity of drilled holes or slits, or expanded metal mesh plates each obtained by expanding an incised metal plate may be used as the perforated plates.

Since air is allowed to flow between the inside and outside of the reflector 2 through holes 5a of the punched metal plates 5, a space defined by the reflector 2 and the front glass 3 around the lamp body 1 is not a hermetic space and, hence, heat generated when the lamp body is lit can be released to the outside through the holes 5*a*. Therefore, a higher-pressure and higher-wattage lamp body can be employed as the lamp body, making it possible to produce a discharge lamp, for example, having a wattage higher than 150 W.

Even if the lamp body 1 explodes, broken pieces of the lamp body 1 do not pass through the holes 5*a* thereby to be prevented from scattering outside.

Since the discharge lamp can employ the higher-pressure and higher-wattage lamp body and effectively prevent the scattering of the broken pieces of the lamp body at the explosion of the lamp body, the discharge lamp serves as a safe light source having a high brightness.

Second Embodiment

Figure 3:
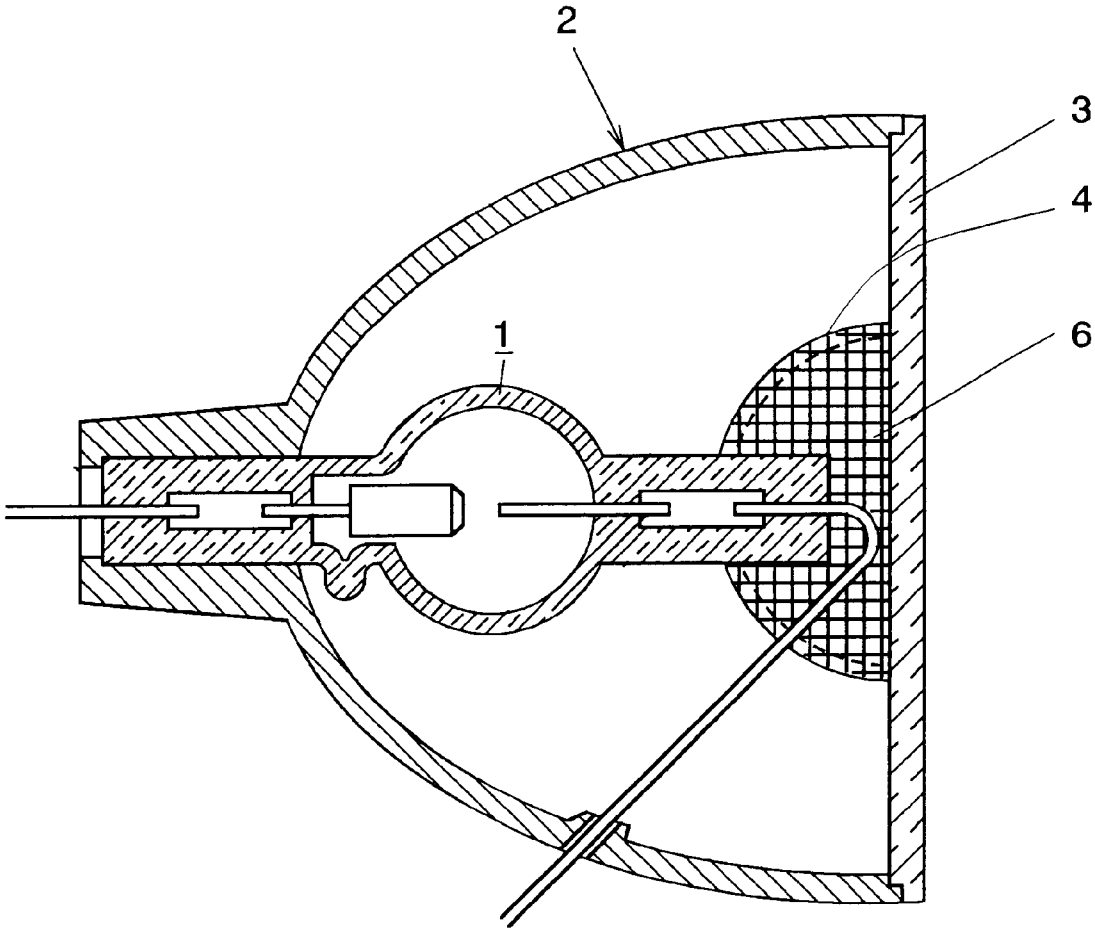
FIG. 3 is a vertical sectional view illustrating a second embodiment.
Figure 4:
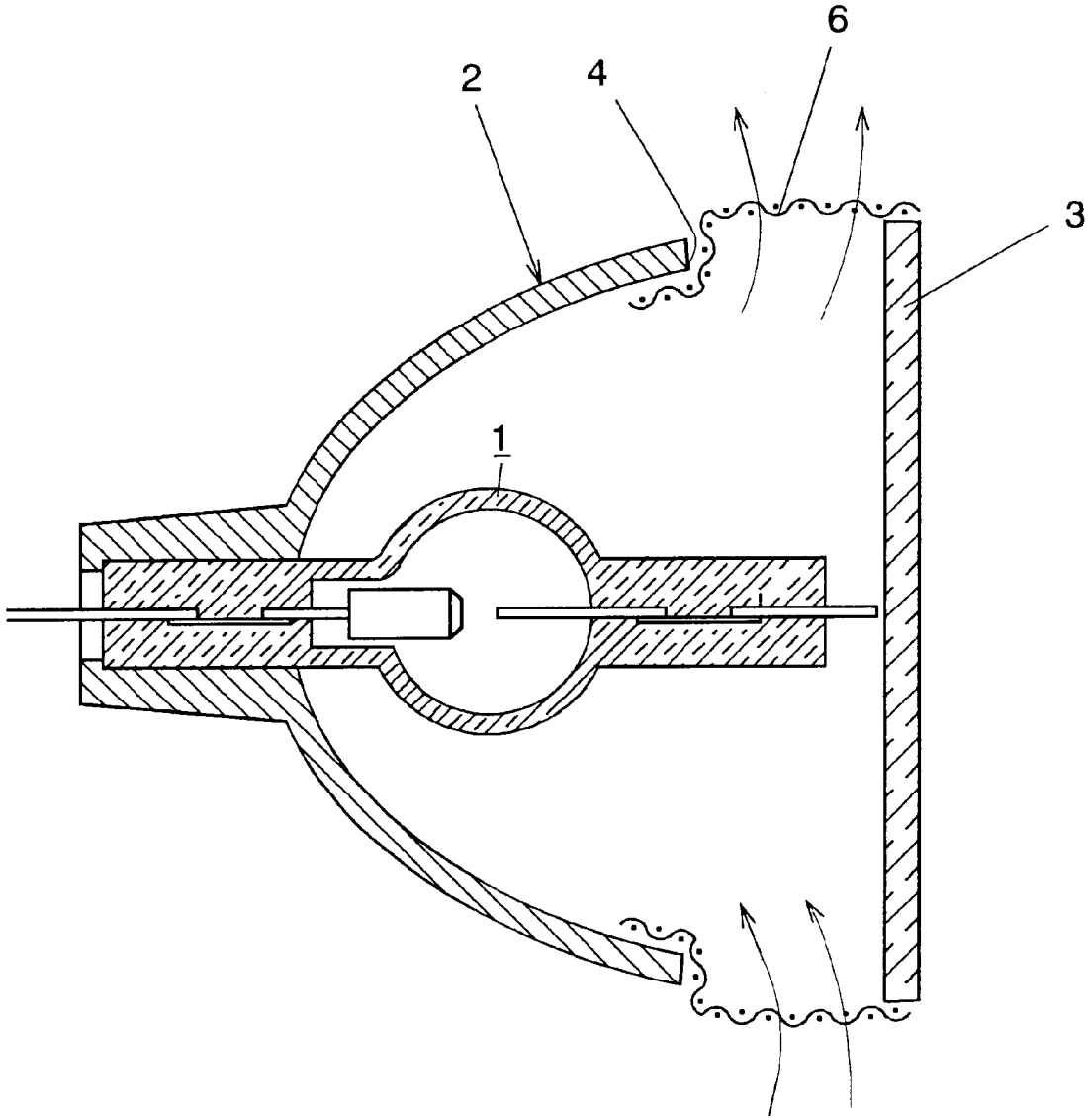
FIG. 4 is a cross sectional view illustrating the second embodiment.

FIGS. 3 and 4 are a vertical sectional view and a cross (plan) sectional view, respectively, illustrating a discharge lamp according to a second embodiment of the invention.

The discharge lamp of the second embodiment has substantially the same construction as the discharge lamp of the first embodiment, except that metal mesh sheets 6 are used instead of the punched metal plates 5 as the perforated plates.

Since air ventilation is achieved through meshes of the mesh sheets 6, heat generated when the lamp body 1 is lit is released to the outside through the meshes of the mesh sheets 6. Further, even if the lamp body 1 explodes, the mesh sheets 6 prevent broken pieces of the lamp body 1 from scattering outside.

Third Embodiment

Figure 5:
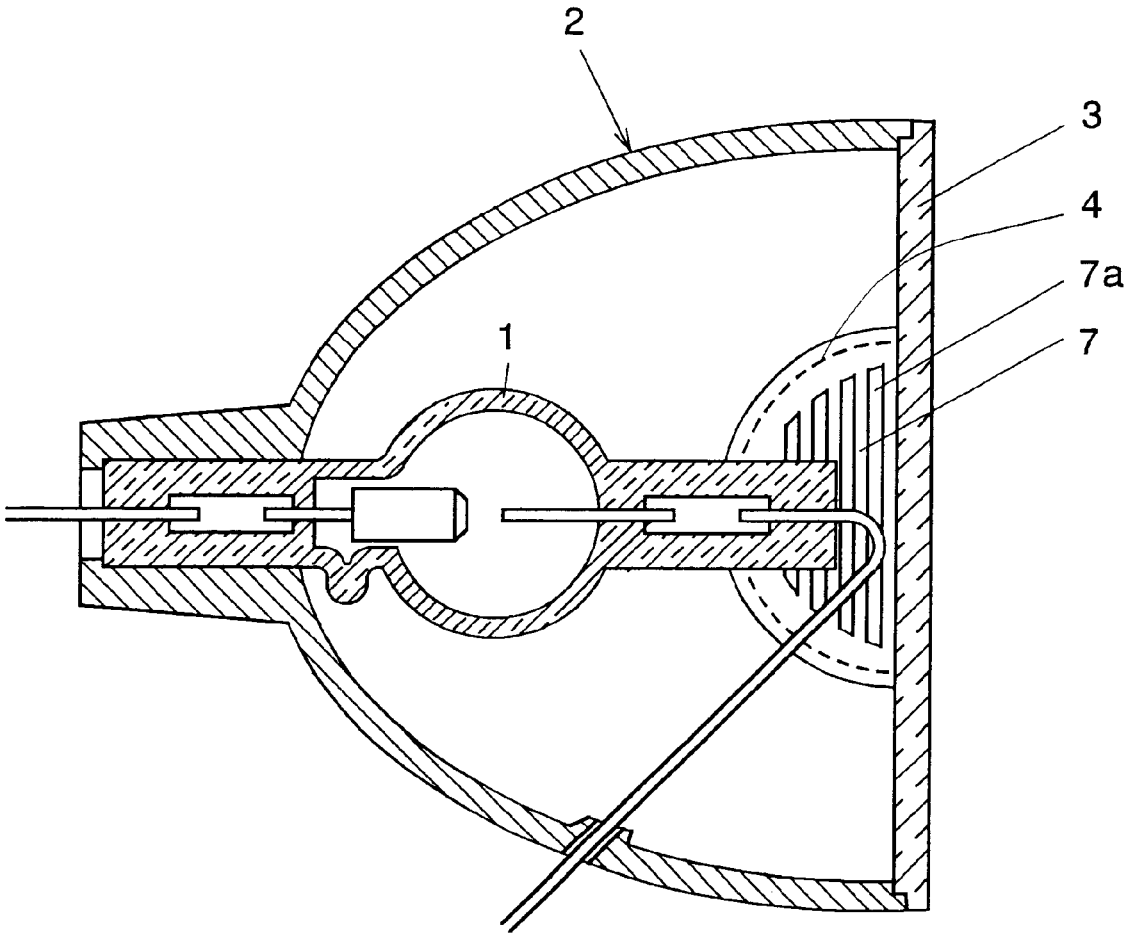
FIG. 5 is a vertical sectional view illustrating the third embodiment.
Figure 6:
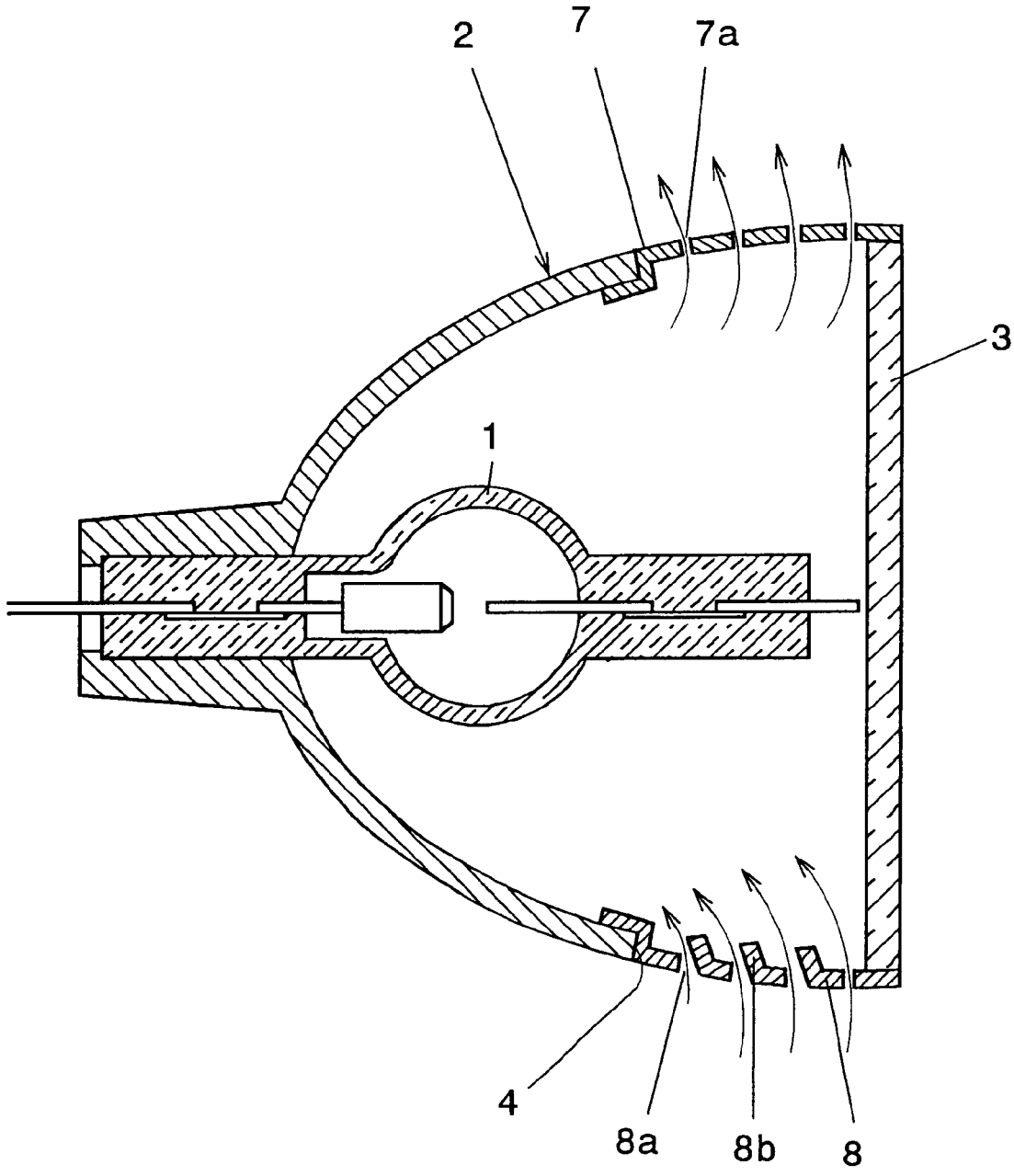
FIG. 6 is a cross sectional view illustrating a third embodiment.
Figure 7:
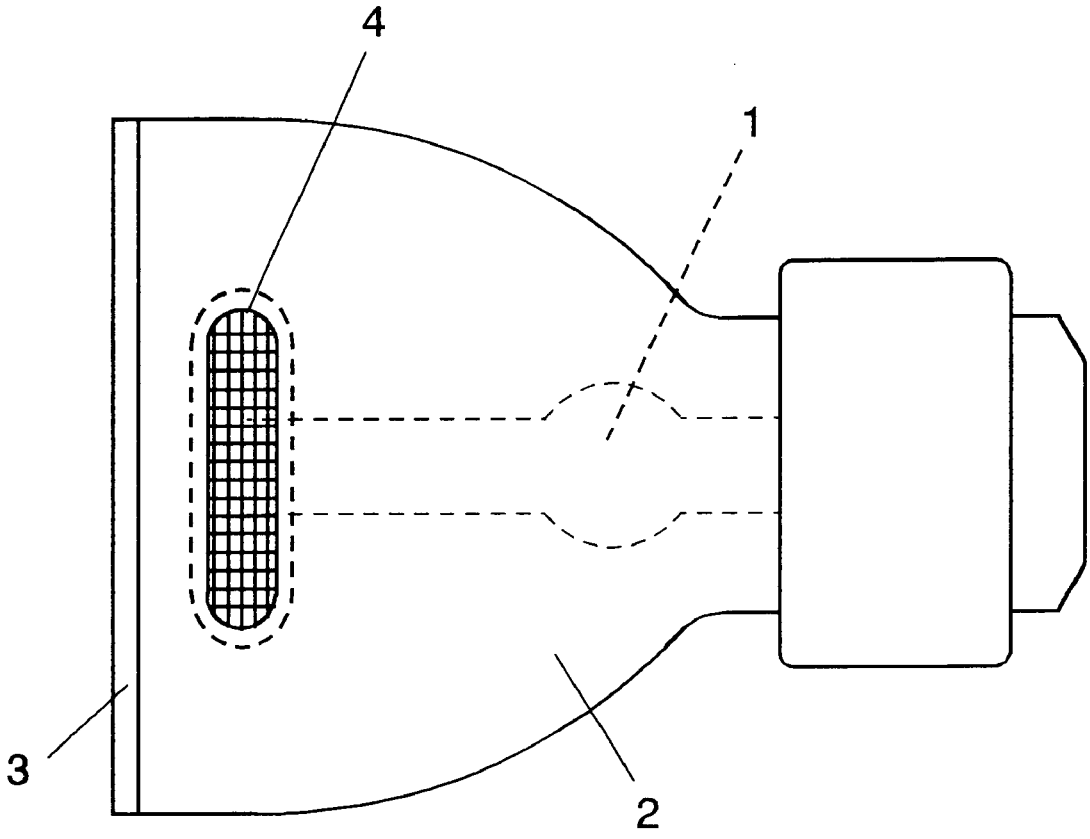
FIG. 7 is a front view illustrating a fourth embodiment.
Figure 8:
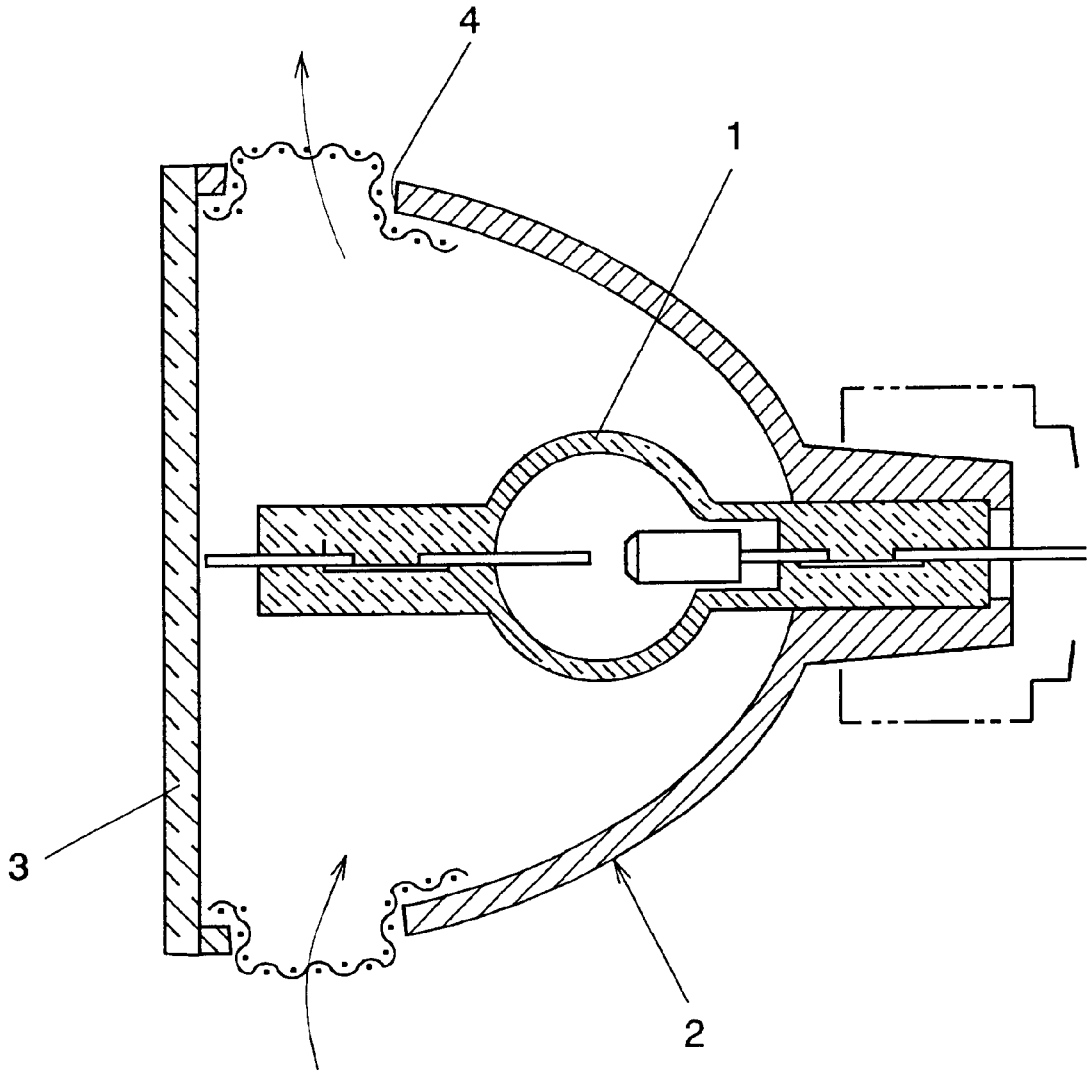
FIG. 8 is a cross sectional view illustrating a fourth embodiment.
Figure 9:
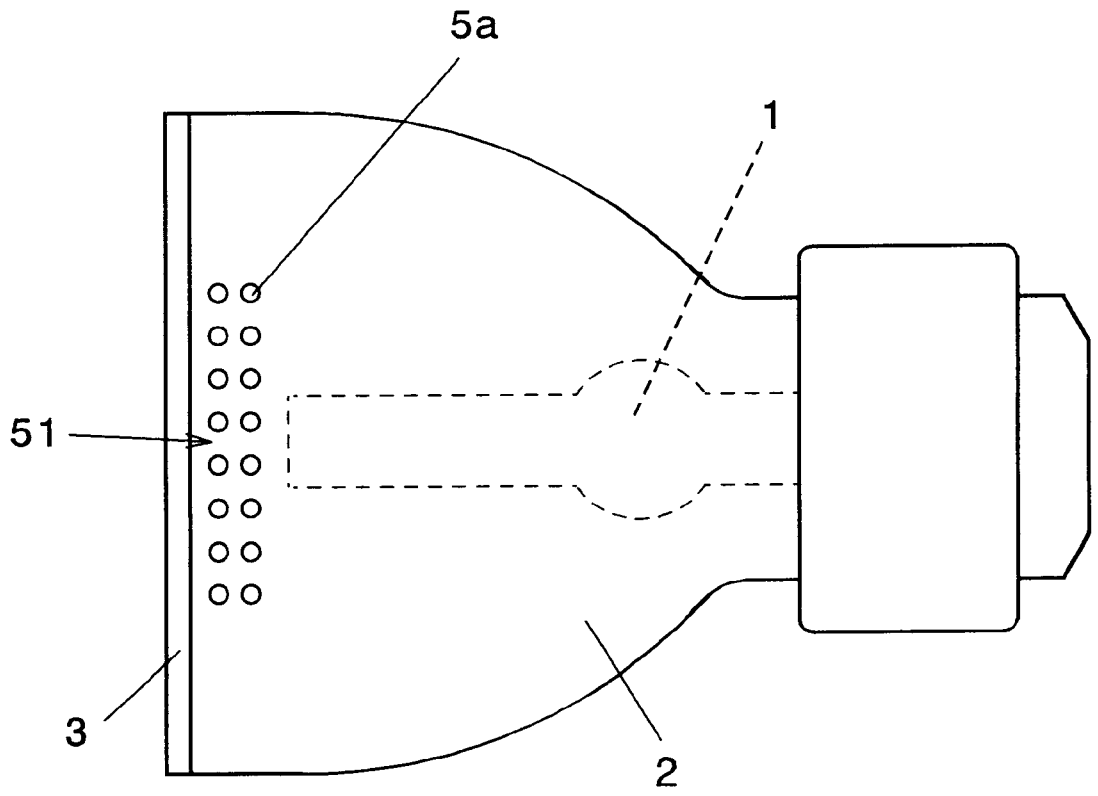
FIG. 9 is a front view illustrating a fifth embodiment.
Figure 10:
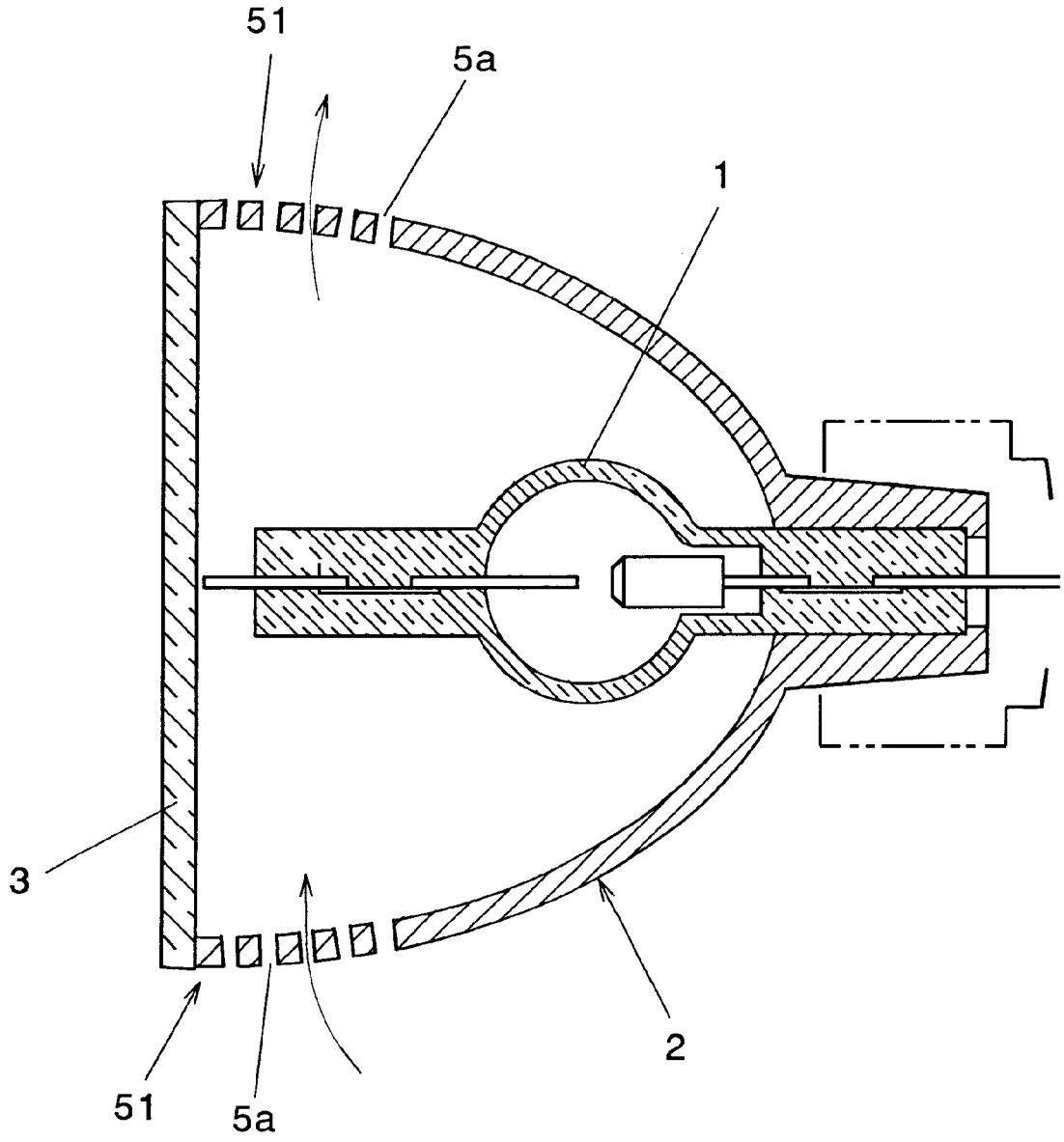
FIG. 10 is a cross sectional view illustrating a fifth embodiment.

FIGS. 5 and 6 are a vertical (plan) sectional view and a cross sectional view, respectively, illustrating a discharge lamp according to a third embodiment of the invention. The third embodiment is substantially the same as the embodiments described above in that air is allowed to flow between the inside and outside of the reflector 2 through the holes 5*a* of the openings 4 formed in the reflector 2 to prevent the temperature rise around the lamp body 1.

In this embodiment, however, two slit plates 7, 8 formed with slits 7*a*, 8*a* are respectively fitted in the two openings 4 of the reflector 2. One slit plate 7 has simple slits 7*a*, while the other slit plate 8 has slits 8*a* and baffles 8*b* provided along the slits 8*a*.

Although provision of the baffles 8*b* is achieved by incising the slit plate 8 for formation of the slits 8*a* and raising the incised portions in this embodiment, the baffles 8*b* may otherwise be provided as separate members.

Outside air introduced through the slits 8*a* is allowed to uniformly flow toward a high temperature portion of the lamp body 1 by the baffles 8*b* to efficiently cool the ambience of the lamp body 1, and then released to the outside through the slits 7*a* of the slit plate 7.

To facilitate the introduction of the outside air through the slit plate 8 provided with the baffles 8*b* and the release of the air through the slit plate 7, it is preferred that the slit plate 8 provided with the baffles 8*b* is located on a lower side of the discharge lamp for utilization of air convection by heat.

For more efficient and positive cooring, an air blower such as a fan may be provided on a lateral side of the discharge lamp for blowing air toward the slits 8*a* so that the outside air can forcibly be supplied to the inside of the reflector 2.

Although the baffles 8*b* are provided on only one of the slit plates 8 in this embodiment, the baffles may be provided on both of the slit plates 7, 8.

Fourth Embodiment

Although the discharge lamps of the first and second embodiments are each constructed such that the reflector 2 has the openings 4 in which the perforated plates 5 or the mesh sheets 6 are fitted for provision of vent portions, a discharge lamp according to a fourth embodiment has two large through-holes as openings 4 formed in non-contact with the front portion (particularly adjacent to the front portion of the reflector 2). The openings 4 may have any shape such as a circular, oval or rectangular shape. The openings 4 have perforated plates 5, the mesh sheets 6 or slit plates 7,8.

Fifth Embodiment

Figure 11:
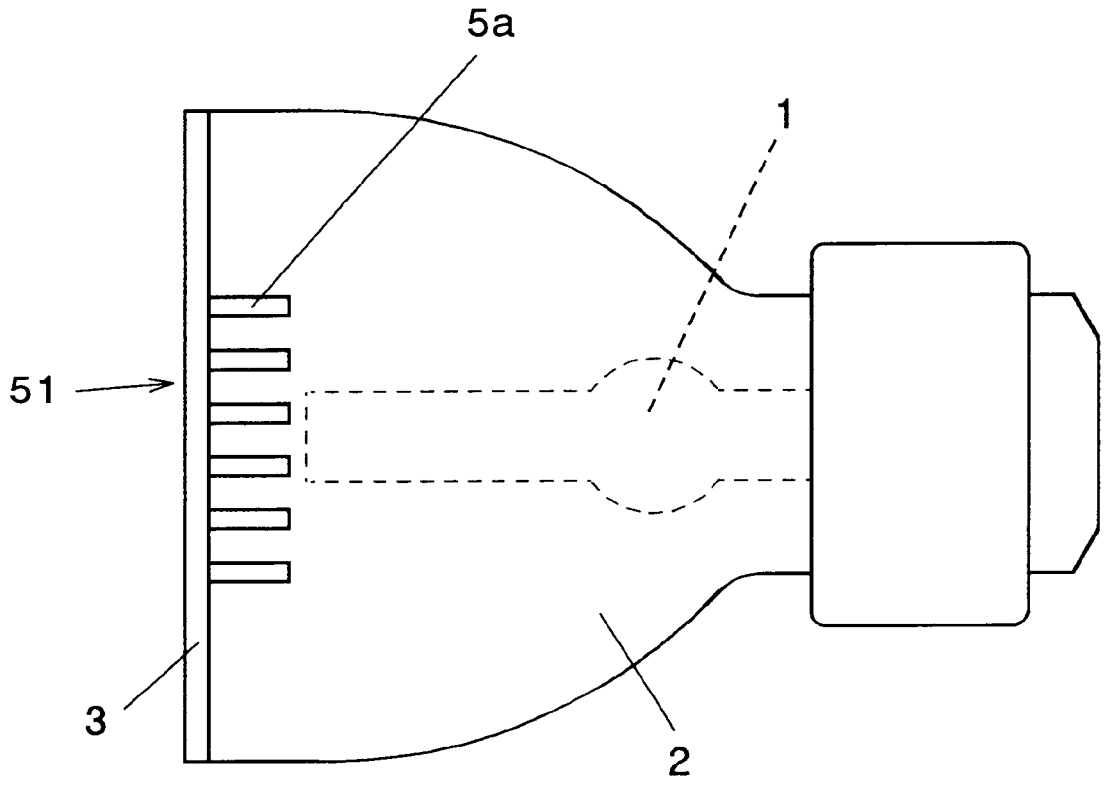
FIG. 11 is a front view illustrating a modified fifth embodiment.
Figure 12:
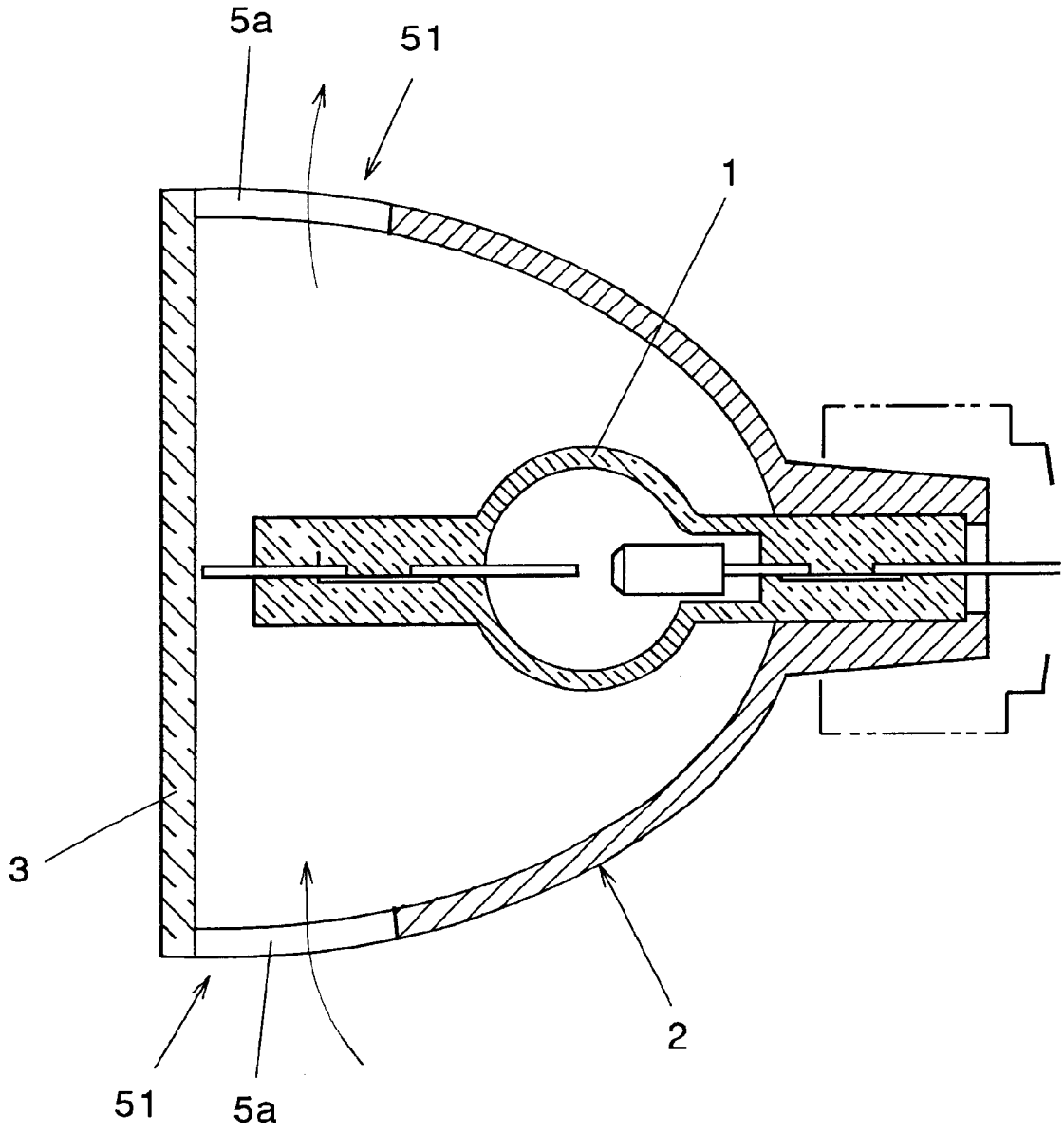
FIG. 12 is a cross sectional view illustrating a modified fifth embodiment.

A discharge lamp according to a fifth embodiment is constructed such that vent portions each having a multiplicity of small diameter through-holes 5*a* are provided integrally with a reflector 2 thereof, particularly adjacent to the front portion of the reflector 2. FIGS. 11 and 12 are a front view and a cross sectional view, respectively, illustrating a modified fifth embodiment. A discharge lamp according to a fifth embodiment is constructed such that holes 5*a* shaped like the teeth of a comb are provided integrally with a reflector 2 thereof, particularly adjacent to the front portion of the reflector 2. The said through-holes 5*a* and holes 5*a* shaped like the teeth of a comb are formed at two points of the front portion of the reflector 2 or at the periphery of the front portion of the reflector 2. The holes 5*a* are in communication with the front portion of the reflector 2.

The fifth embodiments offers the same effects as the first to fourth embodiments and, in addition, are advantageous in that the number of parts can be reduced in comparison with the first to fourth embodiments.

Sixth Embodiment

Figure 13:
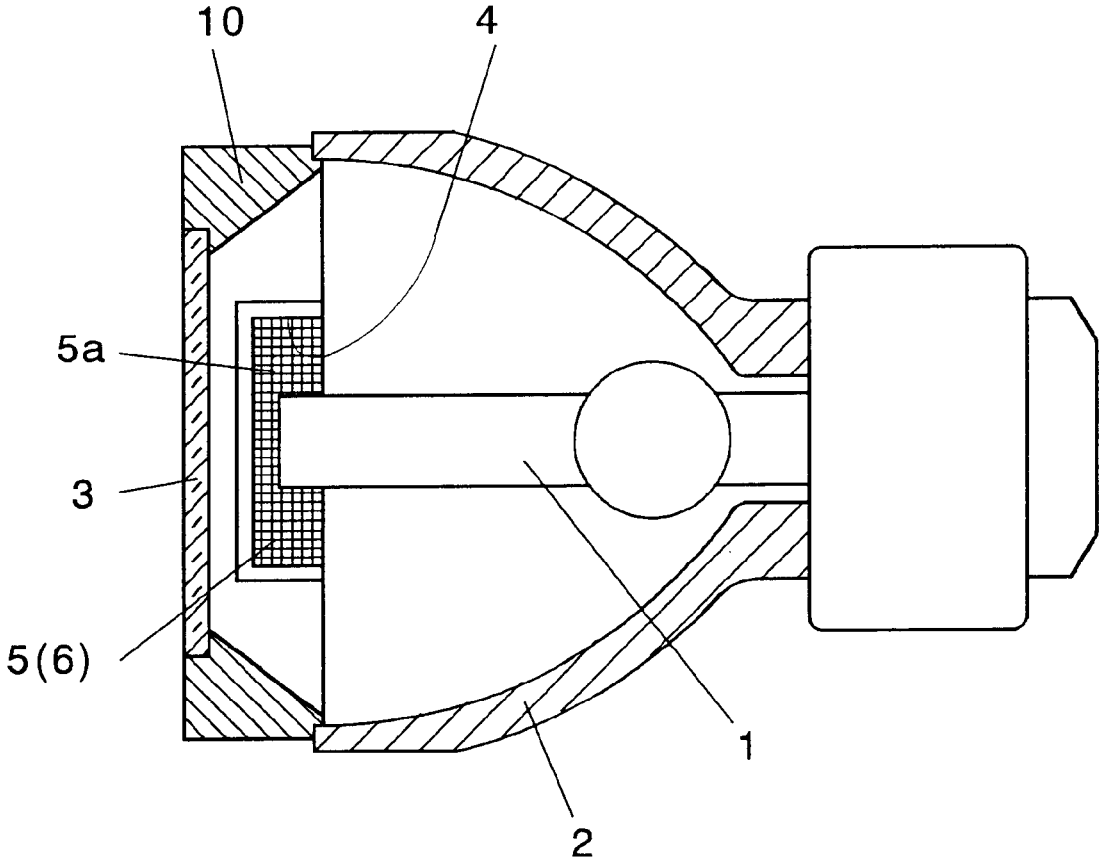
FIG. 13 is a plan sectional view illustrating a sixth embodiment.
Figure 14:
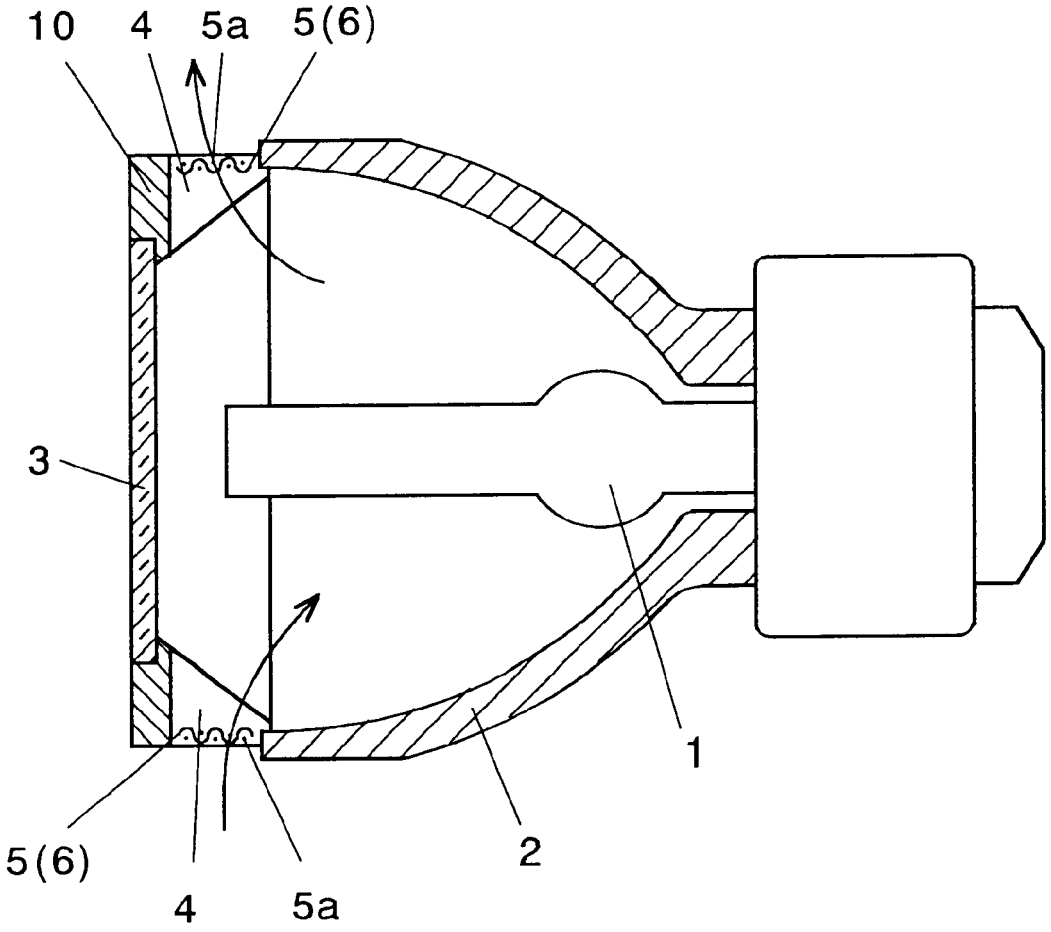
FIG. 14 is a vertical sectional view illustrating a sixth embodiment.
Figure 15:
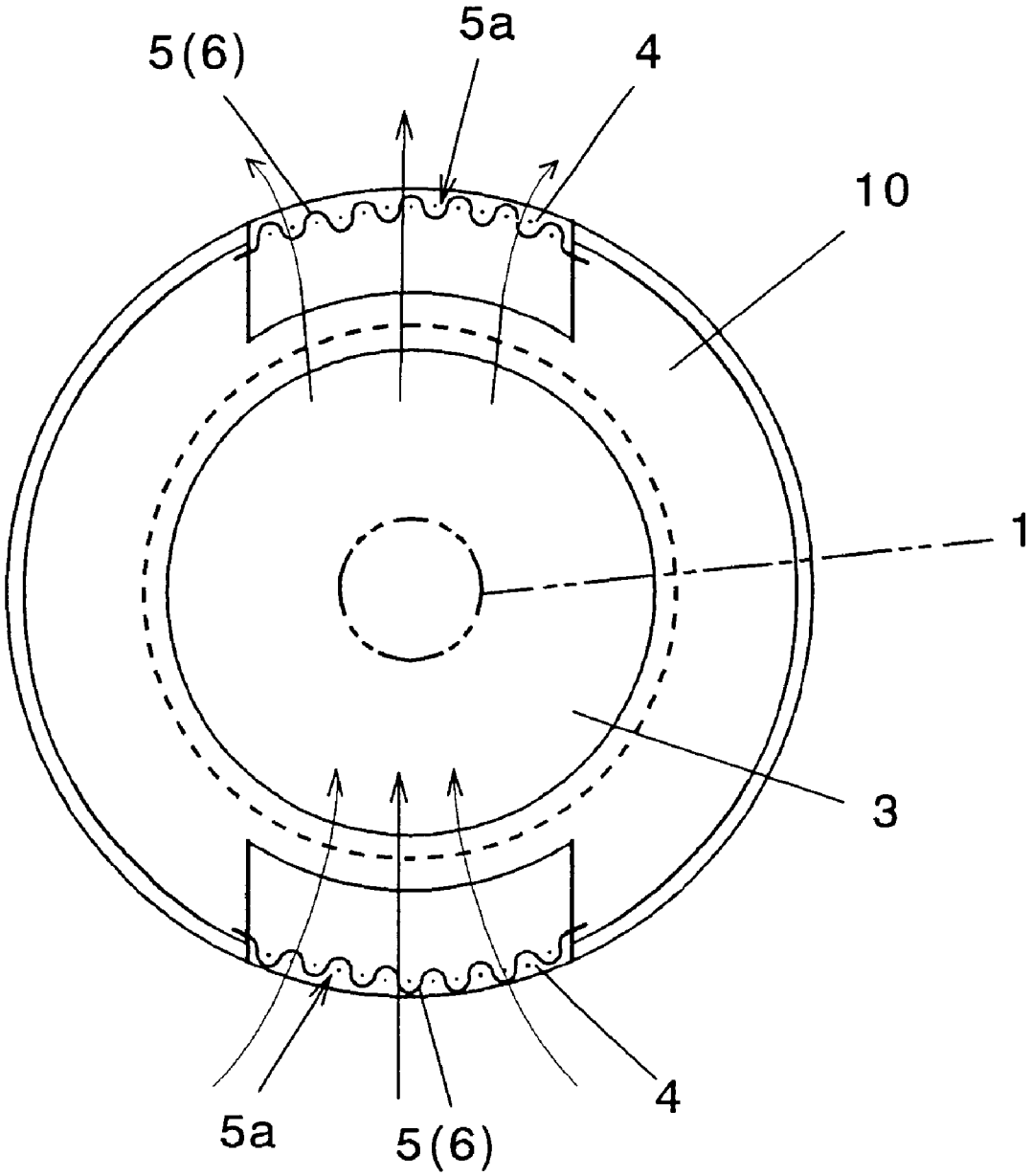
FIG. 15 is a inside view illustrating a ring spacer used for sixth embodiment.

FIGS. 13, 14 and 15 are a vertical sectional view, a cross sectional view, and a inside view of a ring spacer used for this embodiment, respectively, illustrating a discharge lamp according to a sixth embodiment of the invention. As shown, the discharge lamp comprises a lamp body 1, a reflector 2 having the lamp body 1 at the center of it, ring spacer 10 fitted on a front portion of the reflector 2, and a front glass fitted on the ring spacer 10.

The ring spacer 10 has two rectangular openings 4 as the vent portions at the rear portion of it, wherein the front portion of the reflector 2 is fitted. The ring spacer 10 can adopt two rectangular openings 4 at the front portion of it, wherein the front glass 3 is fitted. (not-illustrated)

In the present invention, the positions and configurations of the openings 4 are not limited to those illustrated, but the openings 4 may have any shape such as a circular, oval or rectangular shape and be formed in non-contact with the front portion.

Punched metal plates, ceramic plates with perforations or heat-resistant plastics plates with perforations as perforated plates 5 are respectively fitted in the openings 4 of the ring spacer 10.

Although the punched metal plates 5 (or the metal mesh sheets 6) are used as the perforated plates in this embodiment, plates each formed with a multiplicity of drilled holes or slits, or expanded metal mesh plates each obtained by expanding an incised metal plate may be used as the perforated plates.

Since air is allowed to flow between the inside and outside of the reflector 2 through holes 5*a* of the punched metal plates 5 (or the metal mesh sheets 6), a space defined by the reflector 2, ring spacer 10, and the front glass 3 around the lamp body 1 is not a hermetic space and, hence, heat generated when the lamp body is lit can be released to the outside through the holes 5*a*. Therefore, a higher-pressure and higher-wattage lamp body can be employed as the lamp body 1, making it possible to produce a discharge lamp, for example, having a wattage higher than 150 W.

Even if the lamp body 1 explodes, broken pieces of the lamp body 1 do not pass through the holes 5*a* thereby to be prevented from scattering outside.

Seventh Embodiment

Figure 16:
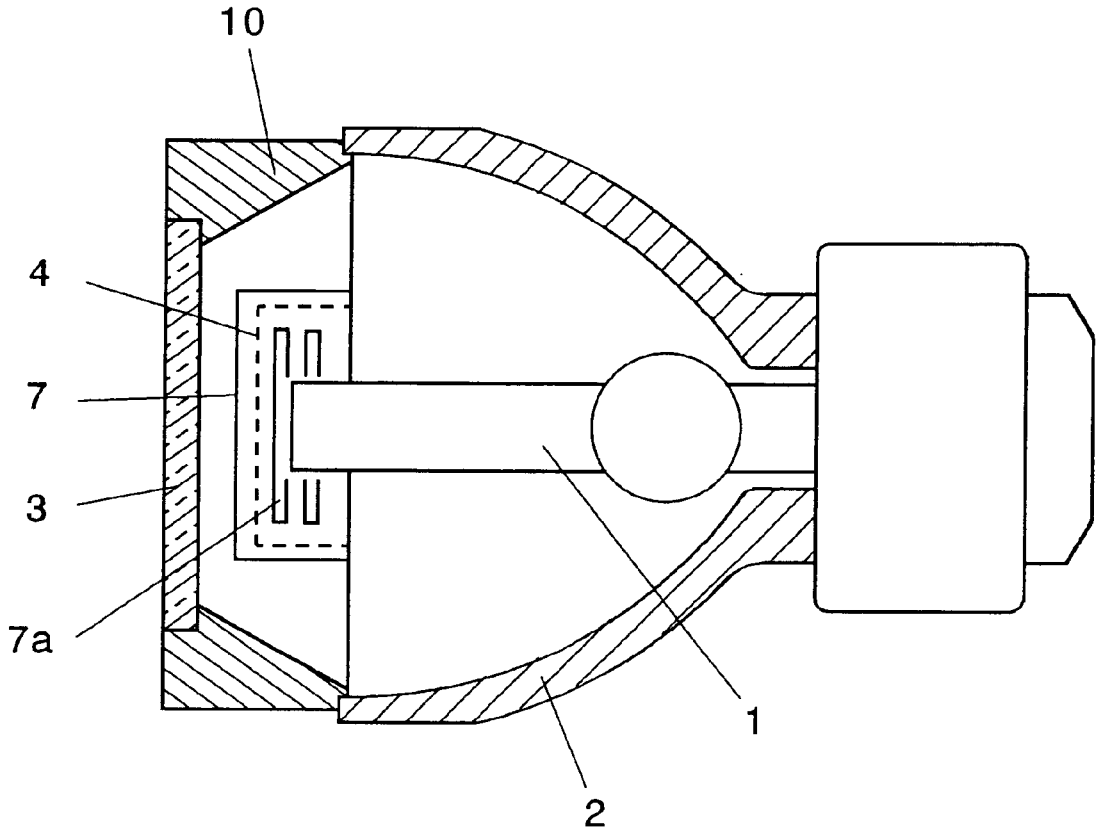
FIG. 16 is a plan sectional view illustrating a seventh embodiment.
Figure 17:
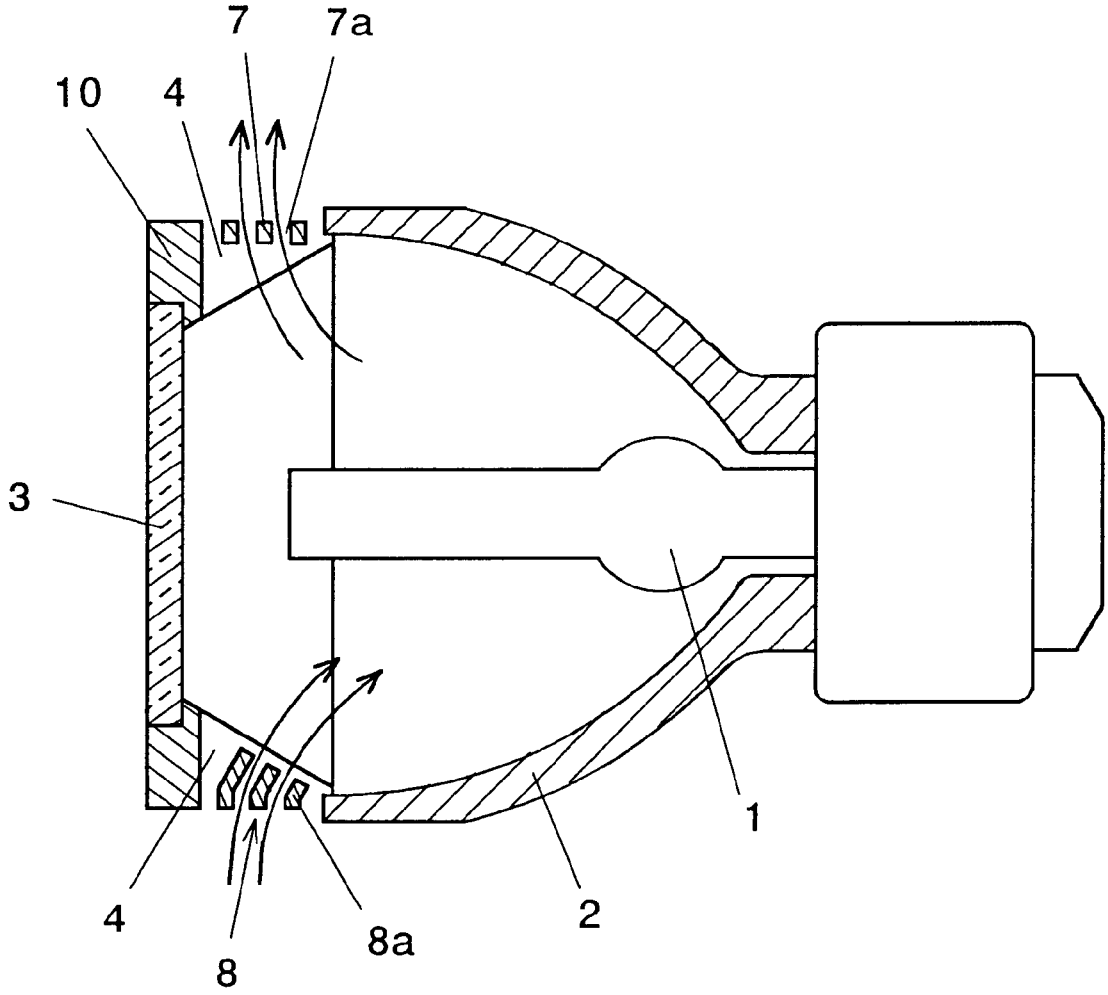
FIG. 17 is a vertical sectional view illustrating a seventh embodiment.
Figure 18:
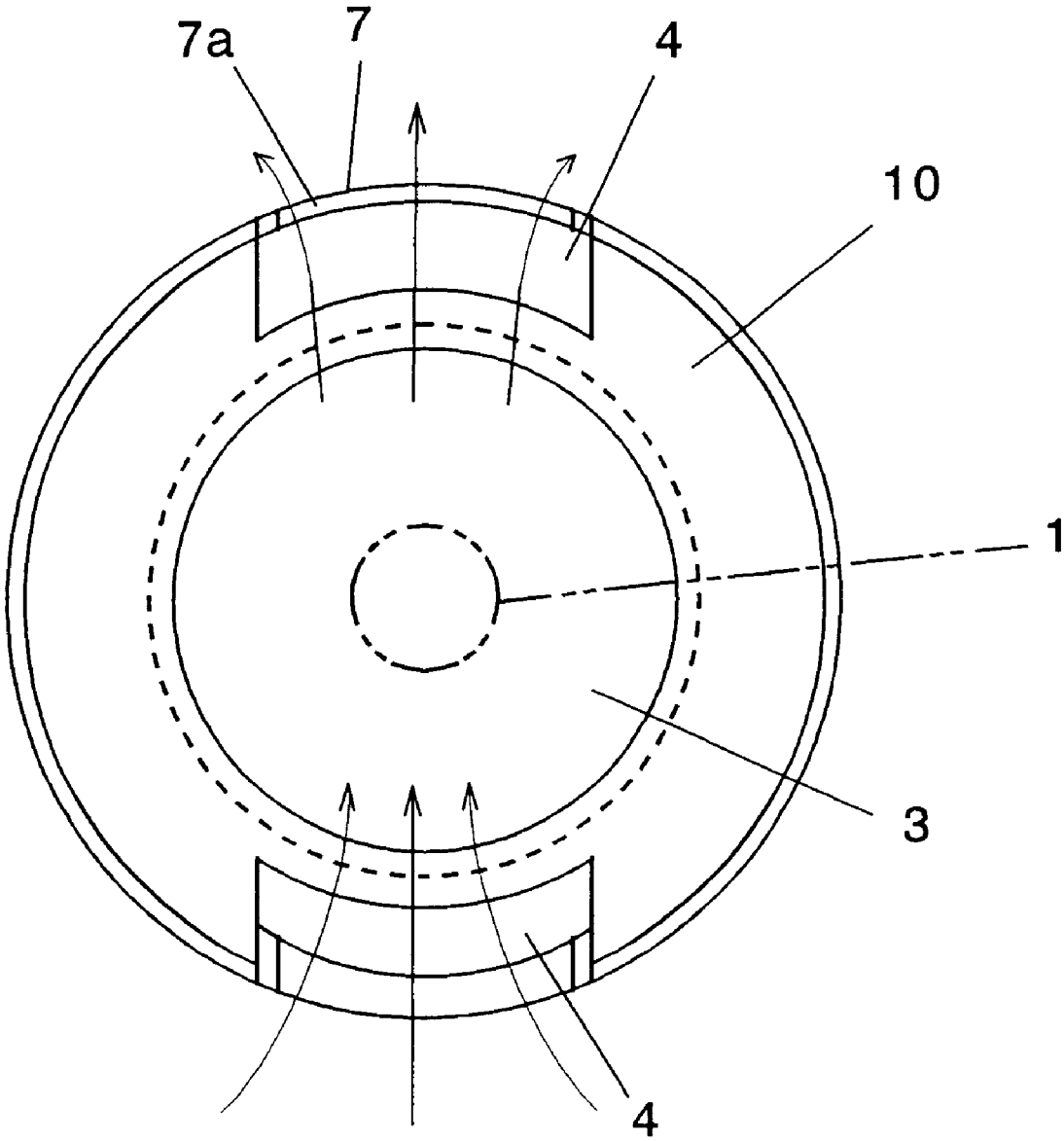
FIG. 18 is a inside view illustrating a ring spacer used for seventh embodiment.

FIGS. 16, 17 and 18 are a cross (plan) sectional view, a vertical sectional view respectively, illustrating a discharge lamp, and a inside view of a ring spacer according to a seventh embodiment of the invention. The seventh embodiment is substantially the same as the embodiments described above in that air is allowed to flow between the inside and outside of the reflector 2 through the openings 4 formed in the ring spacer 10 to prevent the temperature rise around the lamp body 1.

In this embodiment, however, two slit plates 7, 8 formed with slits are respectively fitted in the two openings 4 of the reflector 2. One slit plate 7 has simple slits 7*a*, while the other slit plate 8 has slits 8*a* and baffles 8*b* provided along the slits 8*a*.

Although provision of the baffles 8*b* is achieved by incising the slit plate 8 for formation of the slits 8*a* and raising the incised portions in this embodiment, the baffles 8*b* may otherwise be provided as separate members.

Outside air introduced through the slits 8*a* is allowed to uniformly flow toward a high temperature portion of the lamp body 1 by the baffles 8*b* to efficiently cool the ambience of the lamp body 1, and then released to the outside through the slits 7*a* of the slit plate 7.

To facilitate the introduction of the outside air through the slit plate 8 provided with the baffles 8*b* and the release of the air through the slit plate 7, it is preferred that the slit plate 8 provided with the baffles 8*b* is located on a lower side of the discharge lamp for utilization of air convection by heat.

For more efficient and positive cooling, an air blower such as a fan may be provided on a lateral side of the discharge lamp for blowing air toward the slits 8*a* so that the outside air can forcibly be supplied to the inside of the reflector 2.

Although the baffles 8*b* are provided on only one of the slit plates 8 in this embodiment, the baffles may be provided on both of the slit plates 7, 8.

Eighth Embodiment

Figure 19:
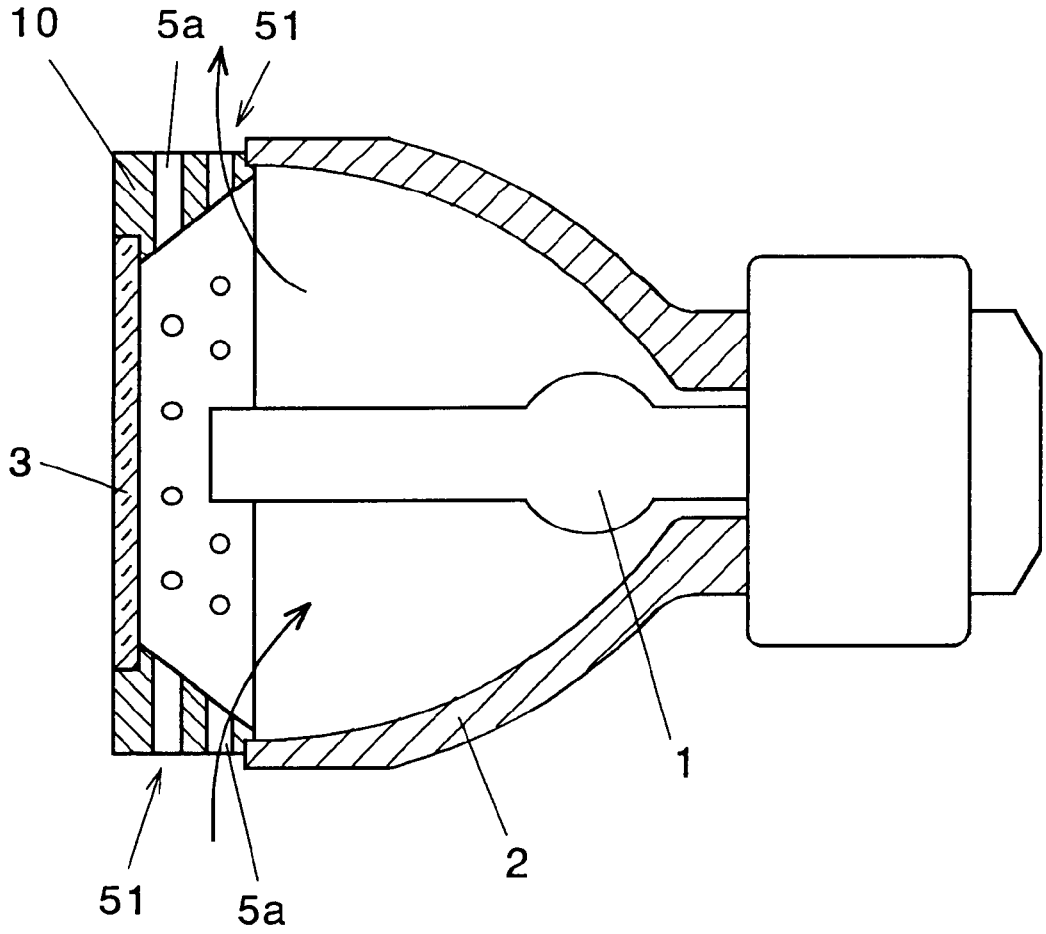
FIG. 19 is a vertical sectional view illustrating a eighth embodiment.
Figure 20:
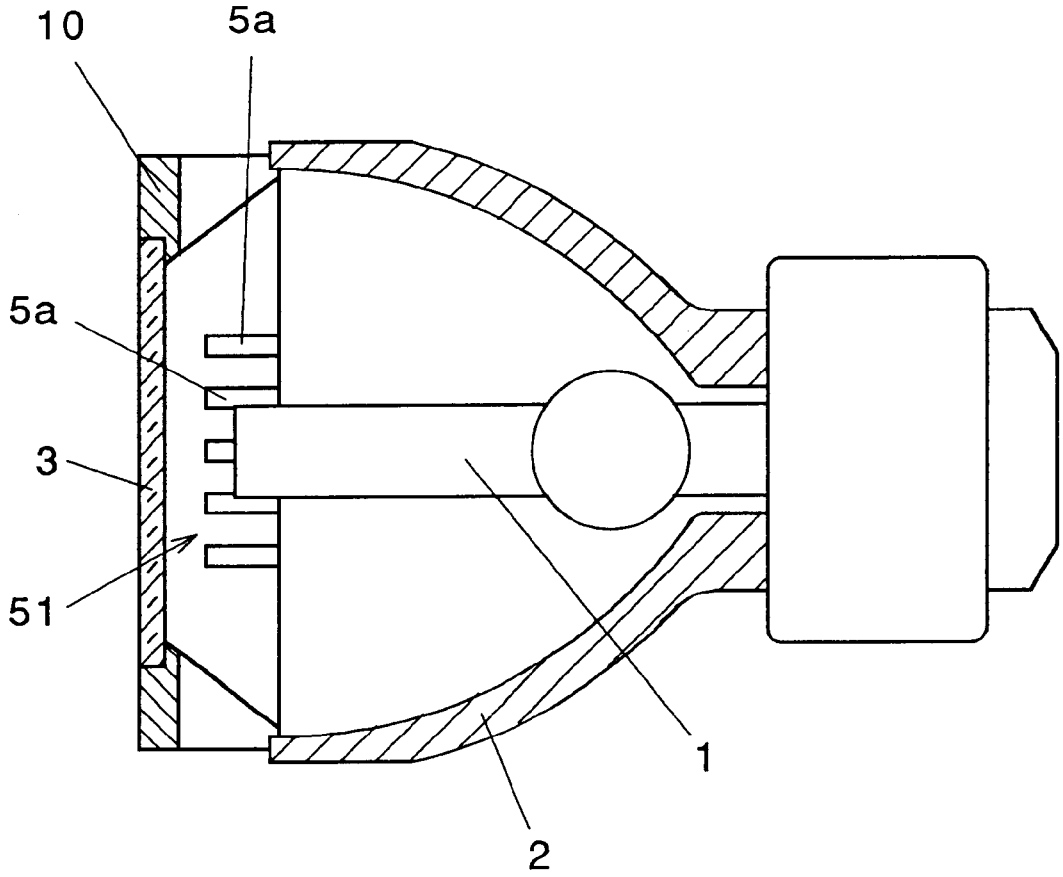
FIG. 20 is a vertical sectional view illustrating a eighth modified embodiment.
Figure 21:
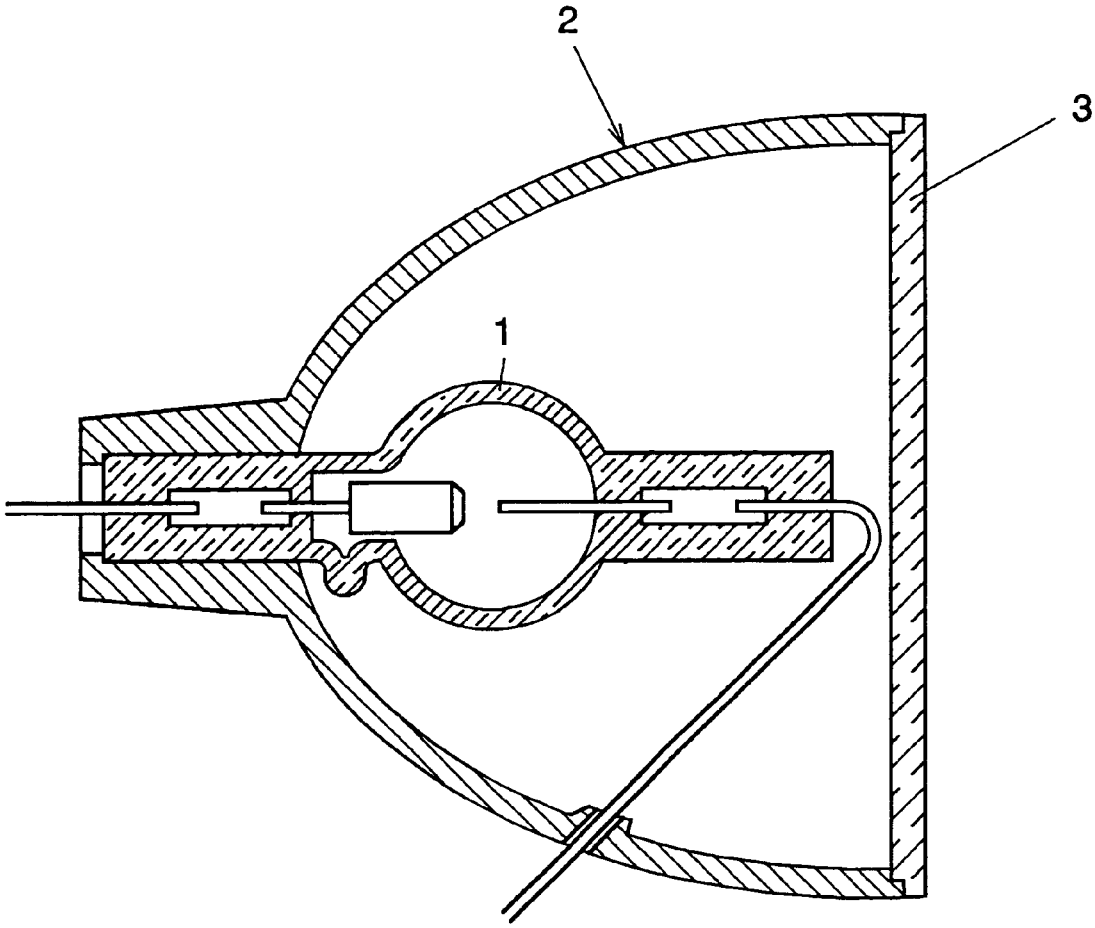
FIG. 21 is a vertical sectional view illustrating a conventional discharge lamp.

Although the discharge lamps of the sixth and seventh embodiments are each constructed such that the ring spacer 10 has the openings 4 in which the perforated plates 5, the mesh sheets 6 or the slit plates 7,8 are fitted for provision of vent portions, a discharge lamp according to a eight embodiment (FIGS. 19,20) are constructed such that vent portions each having a multiplicity of small diameter through-holes are provided integrally with a reflector thereof, or vent portions shaped like the teeth of a comb formed therein (FIG. 20) particularly adjacent to the front portion of the reflector 2 (FIG. 19).

The eighth embodiment offers the same effects as the sixth and seventh embodiments and, in addition, is advantageous in that the number of parts can be reduced in comparison with the said embodiments.

In the first to eight embodiments, the size, number, positions and configuration of the holes or the slits and the fineness of the meshes for the air ventilation may properly be determined on the basis of the size, wattage, pressure and material of the lamp body and the size and configuration of the reflector for effective heat release and for prevention of the scattering of the broken pieces of the lamp body.

As described above, the present invention provides a discharge lamp which employs a higher-pressure and higher-wattage lamp body and is capable of effectively preventing the scattering of broken pieces of the lamp body at explosion of the lamp body.

What is claimed is:

1. A discharge lamp comprising:

a lamp body;

a concave reflector having a front opening and at least one vent opening and holding the lamp body inside the concave reflector, an inside of the concave reflector communicating with an outside of the concave reflector via the at least one vent opening;

a front glass closing the front opening; and a cover having a plurality of through holes and provided in the at least one vent opening to cover the at least one vent opening, said plurality of through holes being provided such that broken pieces of the lamp body do not substantially pass through said plurality of through holes when the lamp body is broken.

2. A discharge lamp according to claim 1, wherein the at least one vent opening is a cut-away portion formed in the reflector.

3. A discharge lamp comprising:

a lamp body;

a concave reflector having a front opening and at least one vent opening and holding the lamp body inside the concave reflector, an inside of the concave reflector communicating with an outside of the concave reflector via the at least one vent opening;

a front glass closing the front opening; and a plate having a plurality of slits and provided in the at least one vent opening to cover the at least one vent opening, the plate having baffles provided along the slits to direct air introduced from the outside of the concave reflector into the inside of the concave reflector through the slits toward a high temperature portion of the lamp body.

4. A discharge lamp according to claim 3, wherein the at least one vent opening is a cut-away portion formed in the reflector.

5. A discharge lamp comprising:

a lamp body;

a concave reflector having a front opening and holding the lamp body inside the concave reflector;

a ring spacer having a front portion and a rear portion which is fitted in the front opening of the reflector, the ring spacer having at least one vent opening through which an inside of the ring spacer communicates with an outside of the ring spacer;

a front glass closing the front portion of the ring spacer; and a cover having a plurality of through holes and provided in the at least one vent opening to cover the at least one vent opening, said plurality of through holes being provided such that broken pieces of the lamp body do not substantially pass through said plurality of through holes when the lamp is broken.

6. A discharge lamp according to claim 5, wherein the at least one vent opening is a cut-away portion formed in the ring spacer.

7. A discharge lamp comprising:

a lamp body;

a concave reflector having a front opening and holding the lamp body inside the concave reflector;

a ring spacer having a front portion and a rear portion which is fitted in the front opening of the reflector, the ring spacer having at least one vent opening through which an inside of the ring spacer communicates with an outside of the ring spacer;

a front glass closing the front portion of the ring spacer; and a plate having a plurality of slits and provided in the at least one vent opening to cover the at least one vent opening, the plate having baffles provided along the slits to direct air introduced from the outside of the ring spacer into the insided of the ring spacer through the slits toward a high temperature portion of the lamp body.

8. A discharge lamp according to claim 7, wherein the at least one vent opening is a cut-away portion formed in the ring spacer.

* * * * *